United States Patent [19]

Timmons

[11] 4,102,470

[45] Jul. 25, 1978

[54] DRAWER FILE FOLDER STOP

[75] Inventor: Jay Timmons, Palos Verdes Estates, Calif.

[73] Assignee: Hiebert, Inc., Torrance, Calif.

[21] Appl. No.: 763,657

[22] Filed: Jan. 28, 1977

[51] Int. Cl.[2] ..... A47F 7/00; A47B 88/00

[52] U.S. Cl. ..... 220/22.3; 211/50; 248/215; 312/183; 312/333

[58] Field of Search ..... 108/60, 61; 312/183, 312/184, 187, 330; 220/22–22.5; 248/222.2, 222.3, 211, 214, 215, 236; 211/49 R, 49 D, 50, 55, 86, 181

[56] References Cited

U.S. PATENT DOCUMENTS

| | | | |
|---|---|---|---|
| 989,566 | 4/1911 | Callaghan | 108/61 |
| 2,303,275 | 11/1942 | Hull | 220/22.5 |
| 3,476,344 | 11/1969 | Pace | 248/222.3 |
| 3,892,451 | 7/1975 | Bruins | 312/183 |
| 3,918,588 | 11/1975 | Walser et al. | 248/215 |

*Primary Examiner*—Casmir A. Nunberg
*Attorney, Agent, or Firm*—Fraser and Bogucki

[57] ABSTRACT

A drawer file folder stop for securing file folders or other objects in place in a drawer includes a plate configured to hook the stop over the top edge of the back or either side or an adjustable divider within the drawer. An elongated, generally planar holder is mounted on and extends outwardly from the plate across part but not all of the width of the drawer between the opposite sides or the length of the drawer between the front and back, and a pin mounted on the plate opposite the holder for engagement in a groove running along the inside surface of the side or back on which the plate is mounted. With the holder free of file folders or other objects the plate is free to slide along the side or back on which it is mounted so as to firmly position the holder against file folders or other objects to be secured within the drawer. Lateral force exerted on the holder by the file folders wedges the plate into a locked position with a non-skid portion thereof bearing against the back, side or divider on which it is mounted and the pin engaging in the groove to prevent twisting of the plate upward and out of the locked position.

8 Claims, 5 Drawing Figures

DRAWER FILE FOLDER STOP

BACKGROUND OF THE INVENTION

1. Field of the Invention

The present invention relates to arrangements for securing file folders or similar objects within the drawers of office furniture and the like.

2. History of the Prior Art

It is frequently necessary or desirable to store file folders or similar objects within the drawers of desks or other pieces of office furniture. The file folders are desirably stored in such a way that they can be opened for removal of papers or other items therein without removal of the file folder itself from the drawer and in such a way that the individual file folders are easily located, removed from the drawer and returned to the drawer as desired. This requires that the file folders be stored in an upright position so that they are easily located and handled without regard to such things as the thickness or the number of the individual folders within the drawer.

A number of arrangements are presently available for the neat and orderly storage of file folders within a drawer. One such arrangement which is well suited for use with relatively thin files involves a pair of strips extending across the drawer at the front and the back thereof and which are engaged by tabs at the opposite ends of the file folders. Other arrangements which have proven to be better suited for use with the storage of relatively large and thick files are those which compress the file folders against one of the vertical inside surfaces of the drawer. One such arrangement utilizes a spring loaded keeper which extends upwardly from the bottom of the drawer and which is manually adjustable so that it can be positioned against the files to secure them in place. A somewhat more elaborate arrangement involves a similar keeper in combination with a pivoting drawer front which disengages the spring loading mechanism of the keeper when the drawer front is pulled down.

While prior art arrangements work reasonably well in most instances, it would be desirable to have an arrangement which provides for greater versatility or flexibility in terms of where the file folders or other objects can be secured within the drawer while at the same time reducing the cost of the arrangement through simplicity in the hardware used. Moreover, it would be desirable to provide a file folder storage arrangement in which the drawers of office furniture and the like could be adapted for easy conversion into file folder storage areas at nominal expense. It would furthermore be desirable to provide a file folder storage arrangement which is simple and easy to use.

BRIEF DESCRIPTION OF THE INVENTION

The present invention provides improved arrangements for storing file folders or other objects within drawers, whcih arrangements utilize a unique drawer file folder stop in combination with drawings having a back or sides or a divider of reduced height and a grooved inside surface. Stops in accordance with the invention are easily installed in such a drawer to convert the drawer for use with file folders. The stop has a plate which serves as a mounting member and which is comprised of a relatively flat body portion adpated to reside against the inside surface of a side or back of or a divider within the drawer and which has a pin or other object protruding therefrom for engagement within the groove in the inside surface of the side, back or divider and a non-skid pad to aid in wedging the stop in place on the side, back or divider. The plate also includes a top portion extending transversely from the top portion for engagement with the top and outside surfaces respectively of the side, back or divider of the drawer to hold the plate in place. The lip portion is spaced from the flat body portion of the plate by a distance slightly greater than the thickness of the side, back or divider of the drawer to allow the plate to be freely moved along and then wedged into place against the side, back or divider of the drawer on which the stop is mounted. An elongated holder extends from the body portion of the plate across part but not all of the width of the drawer to engage the file folders and hold them in place. With the holder free of file folders or other objects, the plate is easily slid along the top of the side or back or divider of the drawer. A single hand is all that is required to slide the plate along the drawer side or back or divider until the holder is securely pressed against a stack of file folders to be stored in the drawer. Release of the holder and the resulting outward movement of the compressed file folders against the holder changes the angle of the holder relative to the side or back or divider of the drawer, thereby wedging the plate into a locked position on the drawer sie or back or divider. The pin remains within the groove to prevent the plate from being twisted upwardly and out of this position. Release of the file folders is accomplished by pushing the holder into the file folders to unwedge the plate, following which the plate is free to slide along the top of the drawer side or back or divider to move the included holder away from the file folders. A simple upward motion of the holder disengages the pin from the groove to free the plate from the drawer side or back when removal of the stop from the drawer is desired.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
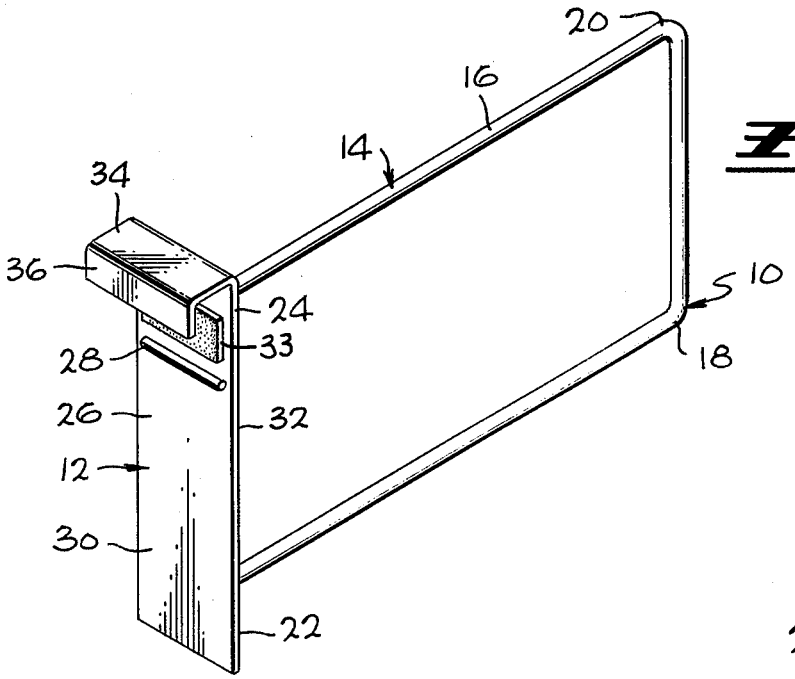
FIG. 1 is a perspective view of a drawer file folder stop in accordance with the invention.
Figure 2:
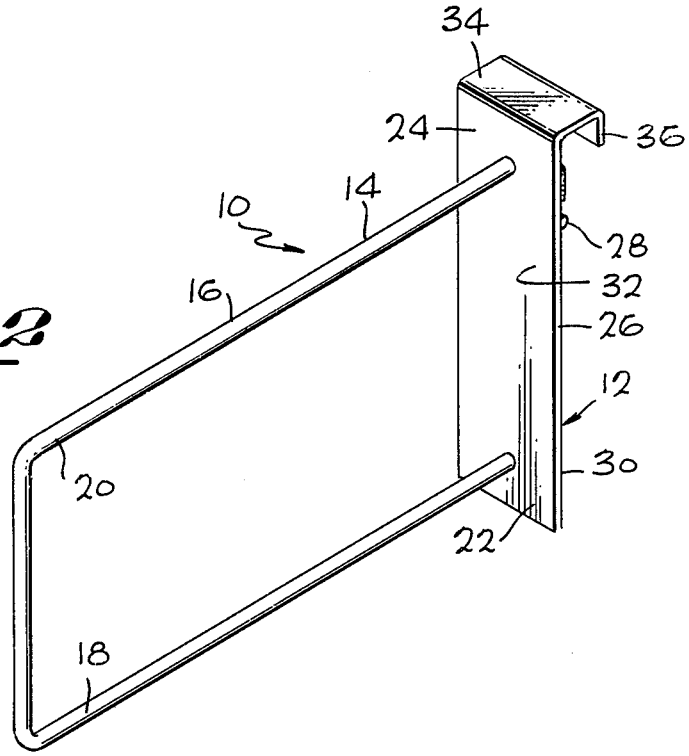
FIG. 2 is a different perspective view of the stop of FIG. 1.

A drawer file folder stop 10 in accordance with the invention is shown in FIGS. 1 and 2 as including a mounting member in the form of a plate 12 having a holder 14 attached thereto. In the present example the holder 14 which is of elongated, generally planar configuration is comprised of a generally U-shaped rod 16 having a pair of opposite ends 18 and 20 respectively secured to the bottom 22 and the top 24 of a flat body portion 26 of the plate 12. The body portion 26 is of generally planar configuration with the plane thereof being normal to the plane of the holder 14.

An elongated, generally cylindrical pin 28 extends across most of the width of the body portion 26 and is secured along its length to a surface 30 forming one of a pair of opposite surfaces 30 and 32 of the body portion 26. The pin 28 is opposite the holder 14 which is joined to the body portion 26 at the surface 32. The pin 28 has a central axis parallel to the plane of the body portion 26 and normal to the plane of the holder 14.

Mounted above the pin 28 on the surface 30 of the body portion 26 of the plate 12 at the top 24 thereof is 2 non-skid pad 33. The pad 33 which is of rubber or other high friction material is fastened to the body portion 26 by glue or other appropriate means.

At the top 24 of the body portion 26 just above the non-skid pad 33, the plate 12 goes through a right angle bend and extends outwardly from the top 24 of the body portion 26 in a direction transverse to the body portion 26 forming a relatively flat, planar top portion 34 the plane of which is normal to the planes of the body portion 26 and the holder 14. At the outer edge of the top portion 34, the plate 12 goes through another right angle bend so as to form a relatively flat, generally planar lip portion 36 spaced apart from, parallel to and extending in the same direction as the body portion 26.

The stop 10 of FIGS. 1 and 2 is installed on the back of or one of the opposite sides of a divider within a drawer by hooking the plate 12 over the top of the back, side or divider so that the body portion 26 resides against the inside surface of the back, side or divider and the holder 14 extends across the interior of the drawer by a distance less than the width of the drawer between the back and front or between the opposite sides or between the back, front or side and a divider. The top portion 34 of the plate 12 rests on the top edge of the back, side or divider of the drawer with the lip portion 36 residing against the top of the outside surface of the back, side or divider.

Figure 3:
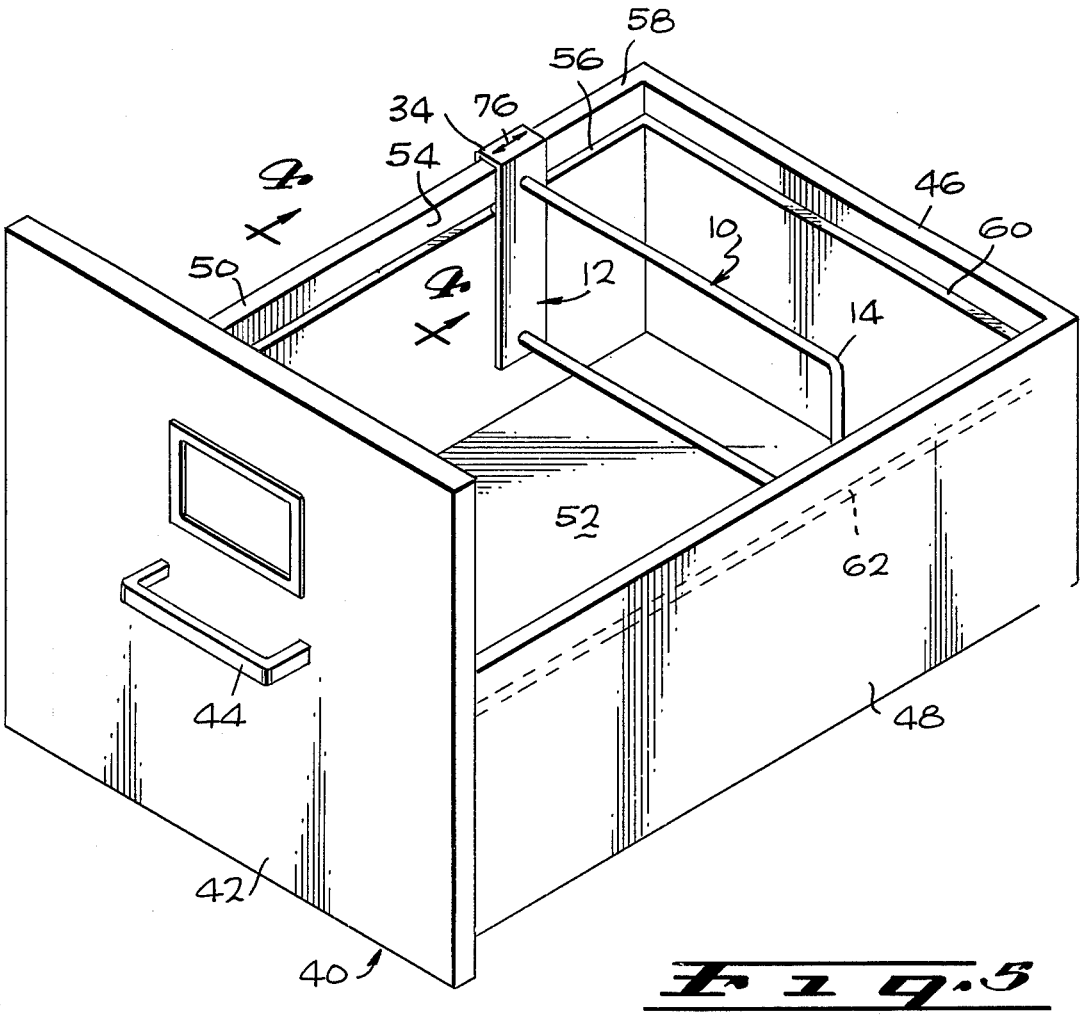
FIG. 3 is a perspective view of a drawer with the stop of FIGS. 1 and 2 installed therein.

A typical installation is shown in FIG. 3 which depicts a drawer 40 of generally rectangular configuration and having a front 42 equipped with a handle 44, a back 46 opposite the front 42, and an opposite pair of sides 48 and 50 extending between the back 46 and the front 42. The drawer 40 also has a bottom 52. The drawer 40 of FIG. 3 is designed so that one or more of the stops 10 can be mounted on the back 46 or either of the sides 48 and 50. The back 46 and the sides 48 and 50 have heights which are substantially equal to each other and which are substantially less than the height of the front 42. The side 50 has an inner surface 54 having a groove 56 therein which extends along the length of the side 50 and which is below and parallel to a top edge 58 of the side 50. The back 46 and the side 48 are similarly equipped with grooves 60 and 62 respectively, the groove 62 being shown in dotted outline in FIG. 3. Although not shown, the drawer 40 may be equipped with a divider disposed transversely between the opposite sides 48 and 50 or longitudinally between the back 46 and the front 42 and equipped with a groove and dimensioned like the back 46 or one of the sides 48 and 50 for mounting the stop 10 thereon.

Figure 4:
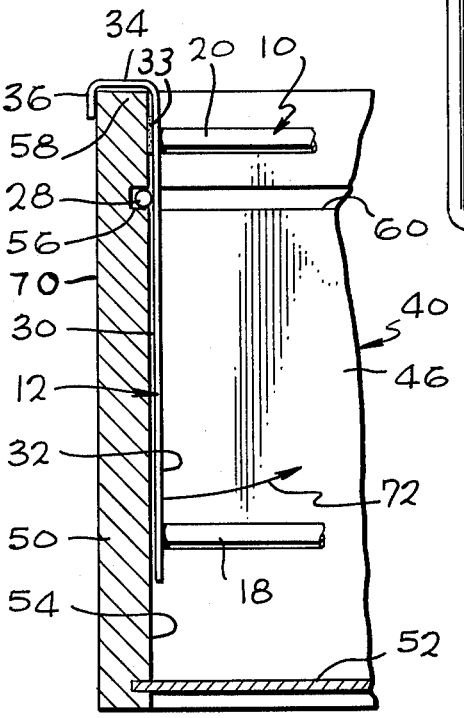
FIG. 4 is a sectional view of a portion of the drawer and stop of FIG. 3 taken along the line 4—4 thereof.

The stop 10 which may be mounted at any position along the lengths of the back 46, the side 48, the side 50 or a divider within the drawer 40 is shown in FIG. 3 as being mounted on the side 50 toward the rear thereof. FIG. 4 is a sectional view of this portion of the side 50 showing a portion of the stop 10 as installed thereon. As seen in FIG. 4 the pin 28 resides within the groove 56. The surface 30 and the included non-skid pad 33 of the body portion 26 of the plate 12 reside against the inner surface 54 of the side 50. The body portion 26 extends from the top edge 58 along a substantial portion of the height of the side 50. The top portion 34 of the plate 12 resides against the top edge 58 of the side 50, and the lip portion 36 of the plate 12 resides against the upper portion of an outer surface 70 of the side 50. The lip portion 36 of the plate 12 is spaced apart from the body portion 26 by a distance slightly greater than the width of the drawer side 50 to permit sliding movement of the stop 10 along the side 50 and wedging of the stop 10 against the side 50 at a desired location for the stop 10. In the present example the drawer side 50 is ½ inch thick while the lip portion 36 of the plate 12 is spaced apart from the body portion 26 by a distance of 9/16 inch.

As seen in FIG. 4 the holder 14 extends across part but not all of the width of the drawer 40 between the opposite sides 48 and 50. Accordingly, the stop 10 is easily removed from the side 50 by rotating it about the top edge 58 of the side 50 in the direction of an arrow 72 shown in FIG. 4 until the pin 28 clears the groove 56. At that point the stop 10 may be lifted straight up. Installation involves the reverse motion in which the top portion 34 of the plate 12 is seated on top of the upper edge 58 of the side 50 with the body portion 26 extending outwardly at an angle relative to the side 50. The stop is then rotated in a direction opposite the arrow 72 until the body portion 26 is seated against the surface 54 of the side 50 and the pin 28 resides within the groove 56. Installation of the stop 10 on the back 46 or the side 48 or a divider and removal therefrom is carried out in the same manner as described in connection with the side 50.

With the stop 10 installed on the side 50 as shown in FIG. 3, the holder 14 is free of file folders or other objects within the drawer 40 and the plate 12 is accordingly free to slide in either direction along the side 50 as shown by an arrow 76 in FIG. 3.

Figure 5:
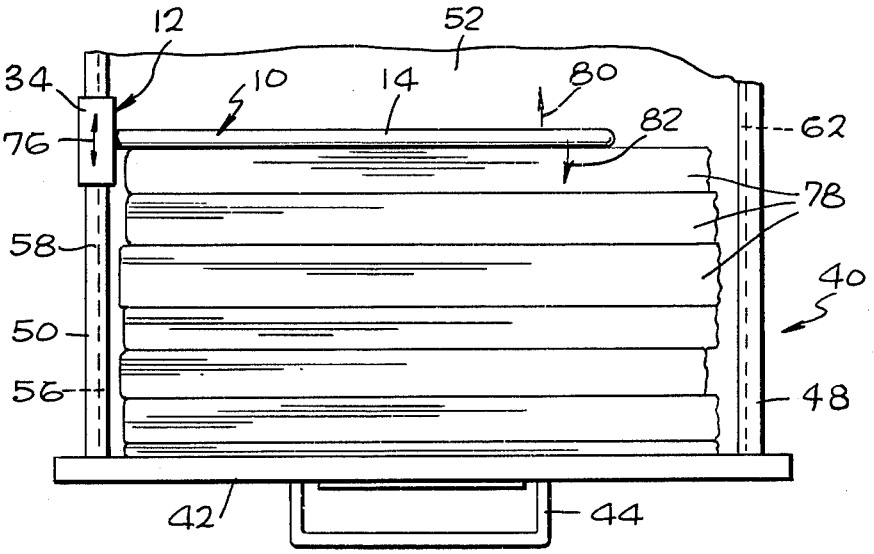
FIG. 5 is a top view of a portion of a drawer showing the manner in which the stop is positioned against a plurality of file folders and is released therefrom.

The procedure for using the stop 10 to secure one or more file folders in place is illustrated in connection with FIG. 5 which shows a plurality of file folders 78 stacked in an upright position against the inside of the front 42 of the drawer 40. With the folders 78 in place, the plate 12 is slid along the top edge 58 of the side 50 until the holder 14 engages the folders 78. The stop 10 is moved as an integral unit in the direction of the arrow 76 with the holder 14 remaining substantially normal to the side 50 so as to slightly compress the folders 78. When the stop 10 is manually released, the compressed file folders 78 expand outwardly by a small amount so as to rotate the holder 14 relative to the side 50 in a direction shown by an arrow 80, thereby making a slight change in the angle of the holder 14 relative to the side 50. This rotation is permitted by the spacing of the lip portion 36 from the body portion 26 of the plate 12 by a distance slightly greater than the width of the drawer side 50. As a consequence of the change in angle, the plate 12 which is integral with the holder 14 is wedged in place at the top of the side 50. Sliding movement of the plate 12 along the side 50 is resisted by the non-skid pad 33. Any tendency of the plate 12 to twist upwardly and away from the side 50 is resisted by the pin 28 within the groove 56. The stop 10 remains locked in this position until released.

Release of the stop 10 is accomplished by pushing on the holder 14 so as to compress the file folders 78 slightly while rotating the holder 14 in the direction of an arrow 82 far enough to restore it to a right angle relative to the side 50. At this point the plate 12 becomes unwedged from and is free to slide along the side 50 in the direction of the arrow 76. By allowing the plate 12 to slide upwardly along the top edge 58 of the side 50 as viewed in FIG. 5, the stop 10 is removed from the region of the file folders 78.

Removal or replacement of one of the file folders 78 normally only requires that the plate 12 be moved a short distance along the side 50. In other instances it may be desirable that the plate 12 be moved along the side 50 a substantial distance such as where a large number of file folders 78 are being added to the drawer. Removal of the stop 10 from the side 50 may be accomplised at any point along the length of the side 50 at which the stop 10 is clear of the folders 78 so that it can be rotated upwardly in the direction of the arrow 72 as shown in FIG. 4.

The plate 12, the rod 16 and the pin 28 can be made of any appropriate material such as steel in which event such parts are joined together such as by welding or other appropriate technique. Moreover, the stop 10 can vary in dimensions depending upon particular requirements and the size of the drawer in which it is being used and the size of the file folders that it is being used with. In one example actually constructed and successfully tested, the rod 16 forms a holder 14 which is approximately 11 inches long from the plate 12 to its outer extremity and approximately 3 inches high between the opposite ends 18 and 20. The rod 16 itself comprises ¼ inch diameter steel rodding. The body portion 26 of the plate 12 is ⅜ inches high from the bottom 22 to the top 24 thereof and is 1 ½ inches wide. The top portion 34 which is also 1 ½ inches wide extends outwardly from the body portion 26 by a distance of 9/16 inch. The lip portion 36 which is 1 ½ inches wide extends downwardly from the top portion 34 by a distance of approximately 3/16 inch. The pin 28 is ⅛ inch in diameter and 1 ⅛ inches long and is welded to the body portion 26 at a location 9/16 inch below the top portion 34.

It will be appreciated by those skilled in the art that file drawer folder stop arrangements in accordance with the invention provide a simple, easy and yet effective way of securing file folders and similar objects within a drawer. The stops 10 are economical to construct in comparison with the more elaborate arrangements of the prior art. At the same time operation of the stop is quite simple and usually requires only one hand to operate. Moreover, the stop 10 is not confined to use with a particular drawer but is interchangeable with other drawers having a back and sides of similar thickness and provided with grooves of the same approximate dimensions.

While the invention has been particularly shown and described with reference to a preferred embodiment thereof, it will be understood by those skilled in the art that various changes in form and details may be made therein without departing from the spirit and scope of the invention.

What is claimed is:

1. A drawer file folder stop comprising a plate having a relatively flat body portion having opposite sides, a top portion extending outwardly from one of the opposite sides of and generally normal to the body portion at an end of the body portion, the top portion extending outwardly from the body portion by a given distance, and a lip portion extending outwardly from the top portion in spaced-apart and generally parallel relation to the body portion, the lip portion extending outwardly from the top portion by distance substantially less than the given distance, a generally cylindrical pin mounted on the body portion at said one of the opposite sides thereof at a location substantially closer to the end of the body portion than to an opposite end of the body portion, and an elongated holder mounted on and extending outwardly from and generally normal to the other one of the opposite sides of the body portion.

2. The invention set forth in claim 1, wherein the holder is of generally planar configuration, the body portion is of generally planar configuration with the plane thereof being generally normal to the plane of the holder, the top portion is of generally planar configuration with the plane thereof being generally normal to the planes of the body portion and the holder, and the generally cylindrical pin has a central axis which is parallel to the planes of the top portion and the body portions and normal to the plane of the holder.

3. The invention defined in claim 1, wherein the holder comprises a generally U-shaped rod having a pair of opposite ends secured to the other one of the opposite sides of the body portion.

4. A piece of furniture having at least one drawer therein, the drawing being of generally rectangular configuration and having a bottom, a back, a front opposite the back and a pair of opposite sides extending between the back and the front, and a drawer file folder stop mounted on the back or one of the pair of sides and having a mounting member and a holder extending outwardly from the mounting member by a distance less than the distance between the back and front of the drawer and less than the distance between the opposite side of the drawer, the mounting member being configured to hook over the top of the back or one of the pair of sides with the back and the pair of sides being generally vertically disposed to mount the stop thereon, the mounting member being configured to permit unhooking and removal of the stop from the drawer by upward turning motion of the stop and to prevent hooking of the mounting member over the top of the back or one of the pair of sides and mounting of the stop thereon by downward turning motion of the stop, the mounting member also being configured to permit sliding movement of the mounting member along the back or one of the pair of sides on which the mounting member is mounted when the holder is free of objects in the drawer and to wedge the mounting member into a fixed position on the back or one of the pair of sides on which the mounting member is mounted when the holder engages objects in the drawer to prevent the stop from sliding along the top of the back or one of the pair of sides on which the mounting member is mounted, the mounting member including means for preventing rotation of the mounting member along the side of the back or one of the pair of sides on which the mounting member is mounted.

5. The invention set forth in claim 4, wherein the back and the pair of sides of the drawer have heights which are equal and which are substantially less than the height of the front of the drawer.

6. A piece of furniture having at least one drawer therein, the drawer being of generally rectangular configuration and having a bottom, a back, a front opposite the back and a pair of opposite sides extending between the back and front, and a drawer file folder stop mounted on the back or one of the pair of sides and having a mounting member and a holder extending outwardly from the mounting member by a distance less than the distance between the back and front of the drawer and less than the distance between the opposite side of the drawer, the mounting member being configured to hook over the top of the back or one of the pair of sides to mount the stop thereon, the mounting member also being configured to permit sliding movement of the mounting member along the back or one of the pair of sides on which the mounting member is mounted when the holder is free of objects in the drawer and to wedge the mounting member into a fixed position on the back or one of the pair of sides on which the mounting member is mounted when the holder engages objects in the drawer, the back and the pair of sides of the drawer each having a groove running along the length thereof generally parallel to the top thereof and the mounting member including means mounted thereon for engaging in the groove in the back or one of the pair of sides on which the mounting member is mounted to prevent twisting of the mounting member upwardly and off of the back or one of the pair of sides on which the mounting member is mounted when the mounting member is wedged into a fixed position.

7. The invention set forth in claim 6, wherein the mounting member has a relatively flat body portion on which the holder is mounted, a relatively flat top portion extending transversely from the body portion and a relatively flat lip portion extending transversely from the top portion, the body, top and lip portions respectively resting on the inside, top and outside surfaces of the back or one of the sides on which the mounting member is mounted, and wherein the means for engaging in the groove comprises an elongated pin mounted on the body portion opposite the holder.

8. The invention set forth in claim 7, wherein the holder comprises a generally U-shaped rod having a pair of opposite ends mounted on the body portion.

* * * * *